US005904474A

United States Patent [19]

Cocchi et al.

[11] Patent Number: 5,904,474

[45] Date of Patent: May 18, 1999

[54] HYDRAULIC PUMP, SUITABLE FOR FOOD PRODUCTS

[75] Inventors: Giuliano Cocchi, Bologna; Gianni Zaniboni, Sasso Marconi, both of Italy

[73] Assignee: Catta 27 S.r.l., Crespellano, Bologna, Italy

[21] Appl. No.: 08/823,200

[22] Filed: Mar. 24, 1997

[30] Foreign Application Priority Data

Apr. 4, 1996 [IT] Italy ..... BO96A0189

[51] Int. Cl.[6] ..... F04C 2/18; F04C 13/00

[52] U.S. Cl. ..... 418/104; 418/134

[58] Field of Search ..... 418/104, 131–134, 418/206.6

[56] References Cited

U.S. PATENT DOCUMENTS

| | | | |
|---|---|---|---|
| 4,073,605 | 2/1978 | Wakeman et al. | 418/134 |
| 5,096,396 | 3/1992 | Welch | 418/39 |

FOREIGN PATENT DOCUMENTS

| | | |
|---|---|---|
| 0061630 A1 | 10/1982 | European Pat. Off. . |
| 0415536 A1 | 3/1991 | European Pat. Off. . |
| 2196677 | 3/1974 | France . |
| 3221325 A1 | 6/1983 | Germany . |
| 89/08798 | 9/1989 | WIPO . |

*Primary Examiner*—John J. Vrablik
*Attorney, Agent, or Firm*—Larson & Taylor

[57] ABSTRACT

The pump has an integrated fluid pressure actuator which provides for the movement and the axial retention of a movable cover which closes one end of the seat of rotation of the lobes of the pump itself. When the pump is in operation, the movable cover closes the seat of the lobes whereas, when the pump is to be washed, the cover is moved away from the lobes to allow effective circulation of the cleaning liquid. The pump is further equipped with a circuit for washing the seals on the shafts, which is automatically active when the movable cover is in the retracted position of the washing phase and which, in this state, draws the cleaning liquid directly from the suction pipe of the pump, makes it circulate behind the seals on the shafts and discharges it into the delivery zone of the pump itself. The pump is also equipped with apertures which perform the function of indicators of malfunctioning of the pump itself in the event of the main seals on the shafts giving way.

8 Claims, 3 Drawing Sheets

HYDRAULIC PUMP, SUITABLE FOR FOOD PRODUCTS

BACKGROUND AND SUMMARY OF THE INVENTION

The invention relates to a hydraulic pump, in particular of the type with lobes, which is used in the food sector, for example for transporting mixtures for ice cream, and is designed for automatic internal washing and equipped with malfunction indicators.

The pump according to the invention differs from known pumps in that it integrates with a compact solution a fluid pressure actuator which provides for the movement and the axial retention of a movable cover which closes one end of the seat of rotation of the lobes of the pump itself. When the pump is in operation, said movable cover closes the seat of the lobes whereas, when the pump is to be washed, said cover is moved away from the lobes to allow effective circulation of the cleaning liquid. The pump according to the invention also differs from known pumps in the fact that it is equipped with a circuit for washing the seals on the shafts, which is automatically active when said movable cover is in the retracted position of the washing phase and which, in this state, draws the cleaning liquid directly from the suction pipe of the pump, makes it circulate behind the seals on the shafts and discharges it into the delivery zone of the pump itself. Lastly, the pump according to the invention is equipped with malfunction indicators which are absent in pumps of known type.

BRIEF DESCRIPTION OF THE DRAWINGS

The major characteristics of the pump in question and the advantages deriving therefrom will be clear from the following description of a preferred embodiment of the same which is illustrated by way of non-limiting example only in the figures of the three attached plates of drawing, in which.

DESCRIPTION OF THE PREFERRED EMBODIMENT OF THE INVENTION

Figure 1:
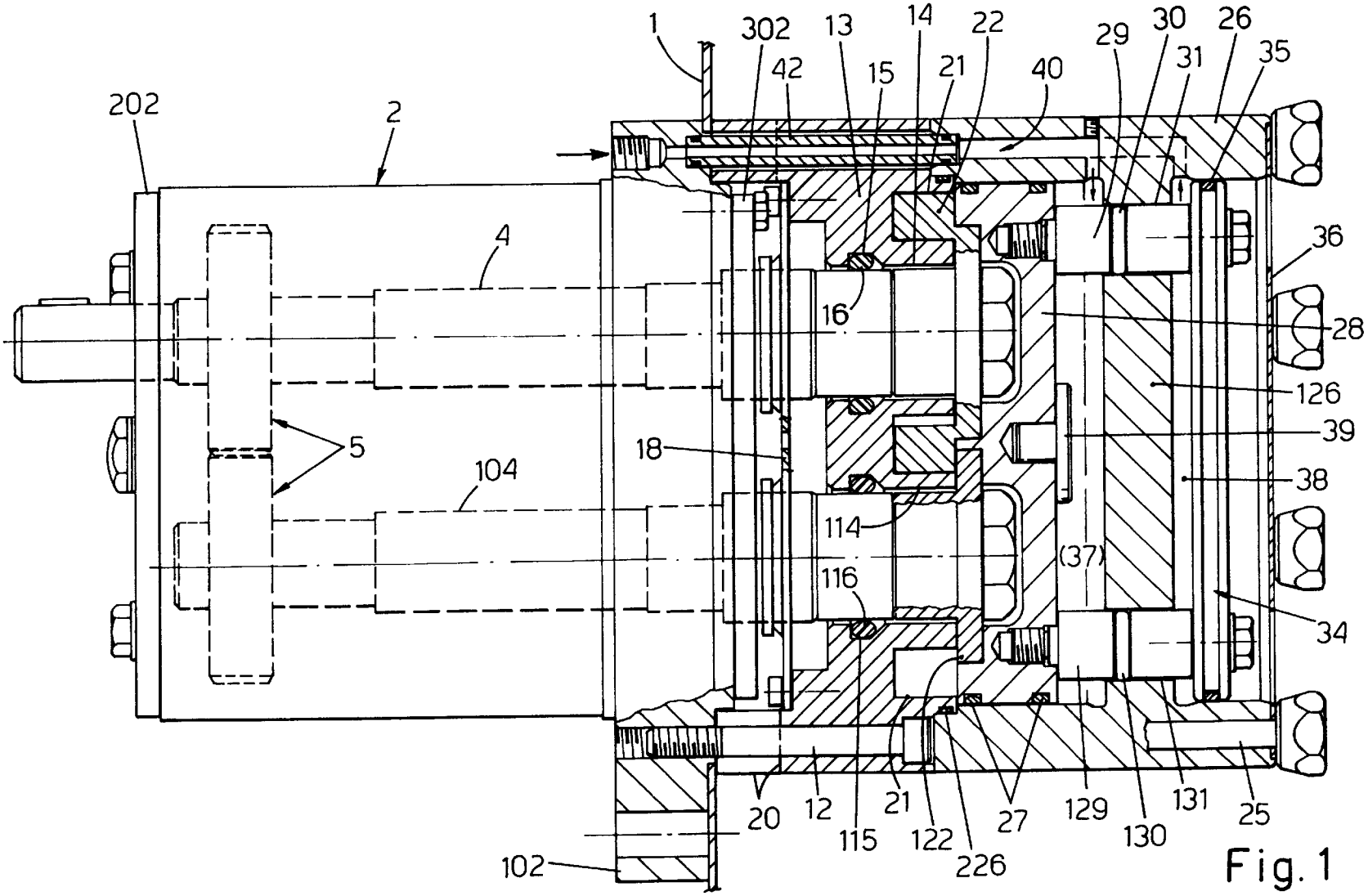
FIG. 1 illustrates the pump in the working state and sectioned along a longitudinal plane which contains the axes of rotation of the lobes.

In FIG. 1, 1 indicates a wall of the housing of the machine on which the pump is mounted. The right-hand face of the wall 1 is normally that which is visible. Fixed on the internal face of the wall 1, by screws and its own flange 102, is the part 2 of the pump body which supports rotatably the parallel shafts 4 and 104 which are interconnected by the gears 5 with an oil bath 2 and one of which projects from the cover 202 of the body 2 for connection to the actuating motor. Provided on the front face of the body 2, opposite the cover 202, is the cover 302 with its own known seals on the shafts 4, 104, and engaged and fixed on this same face by means of evenly distributed screws 12 is the intermediate part 13 of the pump body, illustrated in the details in FIGS. 3, 4 and 5, which is equipped with parallel holes 14, 114 for passage of the shafts 4, 104 and with annular recesses 15, 115 for containing seals 16, 116 which act on suitably designed sections of said shafts. On the face facing the cover 302, the body part 13 bears a perforated cover 18 which is passed through by the shafts 4, 104. In the event of the food product being handled by the pump being drawn through the seals 16, 116 just mentioned, the product passes through the cover 18 and emerges freely to the outside of the body 13 through equidistant apertures 20 which make it possible to indicate a malfunction of the pump visibly.

On the face opposite that associated with the perforated cover 18, the body 13 bears the seat 21, shaped like spectacles, (FIG. 3) in which the lobes of known type 22, 122 which are keyed with correct phasing on the ends of the shafts 4, 104 operate. 121 and 221 indicate the suction and delivery pipes of the pump which are formed in the body 13 and which with one of their ends end square and in a known manner in the middle and in opposite zones of the bottom of said seat 21.

On the same face of the body 13 as the lobes are accommodated in, there is engaged in a sealed manner by means of the seal 226, aligned axially and fixed by means of stud bolts or stay bolts 25 which pass through the body 13 and are anchored to the flange 102 of the body 2, a cup-shaped body 26, with a raised bottom, inside which there is mounted, with the possibility of axial sliding and sealed laterally by means of the seals 27, a piston 28 which normally bears against the body 13 and closes frontally the seat 21 in which the lobes of the pump rotate, performing the function of cover of the pump itself. According to the invention, the cover 28 bears, screwed perpendicularly to the face opposite that facing the lobes and in diametrically opposite positions, pins 29, 129 which, with the seals 30, 130, pass in a laterally sealed manner through suitable apertures 31, 131 arranged in the bottom 126 of the body 26 and which with their other end are fixed perpendicularly and in a sealed manner to a piston 34 which, with its own seal 35, slides in a laterally sealed manner in the bottom chamber of the body 26. A perforated cover 36 is mounted as a double bottom on the body 26, for the purpose of protection, and is retained in place by the nuts of the stud bolts 25.

Figure 2:
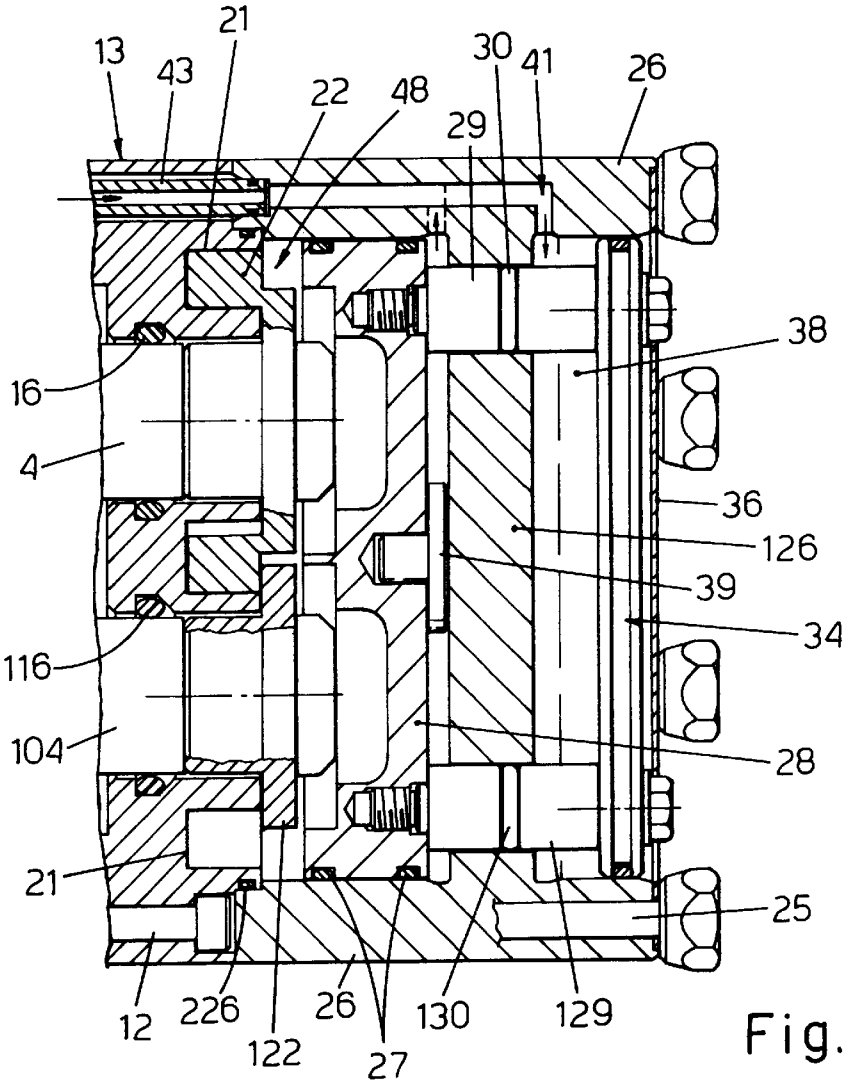
FIG. 2 illustrates the significant part of the pump according to the section in FIG. 1 and in the washing phase.

In the body 26, the parts just mentioned define two sealed chambers 37 and 38 located on opposite sides of the bottom 126. When the pump is in operation, as can be seen in FIG. 1, the chamber 38 is in discharge mode while fluid at a pressure which is expediently greater than the operating pressure of the pump itself is admitted into the chamber 37, which pushes the cover 28 into the position for closure of the pump body. On the other hand, when the pump is in the washing phase, the chamber 37 is connected to the discharge outlet and the pressurized fluid is conveyed into the chamber 38 to act on the piston 34 and move the cover 28 away from the seat 21 of the lobes adequately as far as the limit-of-travel position illustrated in FIG. 2, in which a projection 39 fixed to the centre of the cover bears against the bottom 126.

For the feed and the discharge of the pressurized fluid to and from the chambers 37, 38, ducts 40 and 41 are provided in the perimeter of the body parts 26, 13, 2 and of the flange 102, which ducts end in said flange in respective threaded seats for connection to tubes for supplying and discharging the fluid. That section of the ducts 40, 41 which is associated with body part 13 is provided with small pipes 42 and 43 which engage in a sealed manner with their ends in the sections of duct associated with body parts 26 and 2 so as to simplify the sealed connection of said sections of duct provided in the various pump-body parts.

In the washing phase, the suction pipe 121 of the pump is connected to a delivery source of hot, hygienic liquid which passes through the internal parts of the pump itself at a flow rate far greater than the operating capacity, for example greater by approximately 10 times, while the pump itself is alternately set in rotation and stopped, for example in a time ratio of 1 to 3. The washing phase lasts for example about twenty minutes, after which the pump automatically resets itself with the cover 28 in the operating state.

Figure 5:
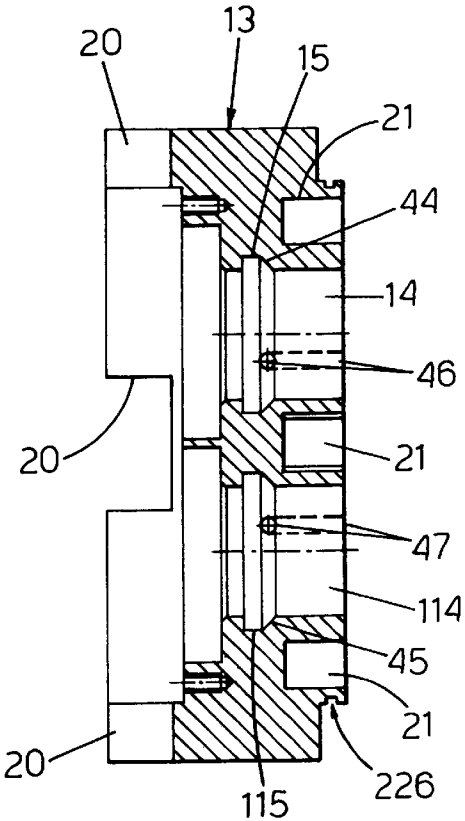
FIGS. 4–5 illustrate other details of the pump body in FIG. 3, according to a lateral view and along the section V—V respectively.
Figure 3:
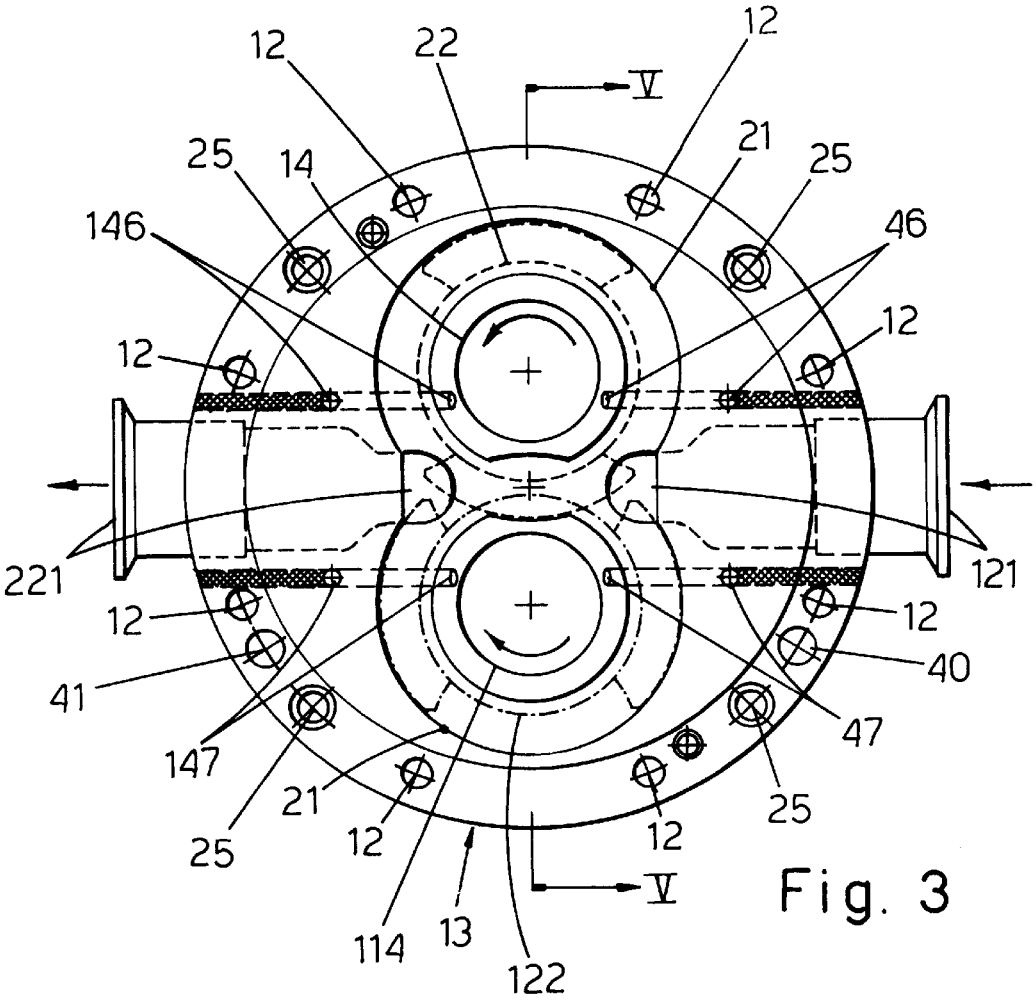
FIG. 3 is a plan view of the intermediate part of the pump body.
Figure 4:
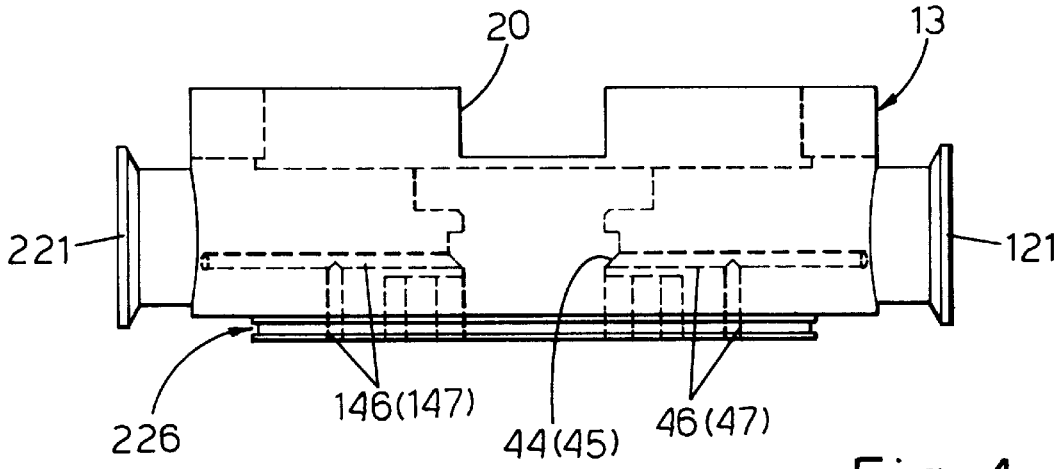

Since, as a result of the play which exists between the seat 21 of the body 13 and the lobes of the pump, some of the food product transported by the pump inevitably reaches the seals 16, 116, provision is made that the seat which contains these seals is equipped with a flank which is flared from the part facing the lobes, as indicated by 44 and 45 in FIGS. 3, 4 and 5 and this is for the purpose of preventing stagnation of the product behind these seals. On this flared flank of the seats of the seals 16, 116, there are open on the suction pipe side, with one of their ends, respective ducts 46, 47 which are formed by drilling operations carried out on the body 13 and which, with their other ends, are open on the face of said body which, when the pump is operating, is in contact with the movable cover 28, laterally and at a short distance from the suction pipe 121. On the same flared flank of the seats which contain the seals 16, 116, there are open on the delivery side, with one of their ends, similar ducts 146, 147 which, with their other end, are open on the face of the body 13 which, when the pump is operating, is in contact with the movable cover 28, laterally and at a short distance from the delivery pipe 221. When the pump is in operation, the ducts 46, 47 and 146, 147 are closed by the cover 28. However, when the pump is in the washing phase and the cover 28 is moved away from the body 13, the ducts 46, 47 and 146, 147 are in free communication with the washing chamber 48 which is constituted between said parts 13, 28, as a result of which the cleaning liquid tends to circulate in the same, reaches in front of the seals 16, 116 through the ducts 46, 47, washes the internal face of these seals uniformly and is discharged through the opposite ducts 146, 147. This solution ensures perfect cleaning of all the internal parts of the pump affected by the product, in a completely automatic manner and without the presence of pipes outside the pump itself.

We claim:

1. A hydraulic pump for pumping a liquid product comprising:

respective first and second lobes;

respective first and second longitudinal drive shafts attached to respective said first and second lobes for rotating respective said first and second lobes;

a pump body including;

a first face, said first face including therein respective first and second annular seats and in which respective said first and second lobes rotate to pump the liquid product, a second face opposite to said first face, said second face including respective first and second drive seats through which respective said first and second drive shafts extend to respective said first and second lobes located in respective said first and second annular seats of said first face, respective first and second drive seals in respective said first and second drive seats which surround and seal respective said first and second drive shafts, said first and second seals defining (a) respective first and second flanks of respective said first and second drive seats located on a side of respective said first and second drive seats adjacent said first face and (b) respective first and second spaces between respective said first and second flanks and said first face, a suction pipe which conducts the liquid product to an inlet side of said first and second annular seats, a delivery pipe which conducts the liquid product away from an outlet side of said first and second annular seats, respective first and second inlet ducts for respective said first and second flanks of respective said first and second drive seats, said first and second inlet ducts having respective inlet ends adjacent said suction pipe and respective flank ends in respective said first and second flanks, and respective first and second outlet ducts for respective said first and second flanks of respective said first and second drive seats, said first and second outlet ducts having respective outlet ends adjacent said delivery pipe and respective flank ends in respective said first and second flanks located opposite to respective first and second flank ends of respective said first and second inlet ducts;

a cover in said pump body which covers said first and second annular seats in said first face, said inlet ends of said inlet ducts, and said outlet ends of said outlet ducts; and an actuator which selectively moves said cover in said pump body between a pumping position and a cleaning position, such that (a) when said cover is in the pumping position, said cover (i) is pressed against said first face to close said first and second annular seats, and (ii) covers said inlet ends of said inlet ducts and said outlet ends of said outlet ducts, and (b) when said cover is in the cleaning position, said cover is spaced from said first face so that said first and second annular seats are open and said inlet ducts and outlet ducts are uncovered, whereby, when a cleaning liquid is forced from said suction pipe to said delivery pipe, the cleaning liquid cleans (i) the first face of said pump body including said first and second annular seats as well as said first and second lobes therein as the liquid flows from said suction pipe to said delivery pipe and (ii) said flanks of said first and second drive seats and adjacent portions of said first and second seals as well as said first and second spaces as the cleaning liquid also passes through said inlet ducts and said outlet ducts.

2. A hydraulic pump as claimed in claim 1, wherein said first and second flanks have a flared shape.

3. A hydraulic pump as claimed in claim 2:

wherein said first and second drive shafts are parallel and respective gears connect said first and second drive shafts to provide a phased rotation thereof, one of said first and second drive shafts being keyed for driving by an actuating motor;

wherein said pump body includes a first body part which rotatably supports said first and second drive shafts away from said second face and which contains an oil bath for said gears;

wherein said pump body includes a second body part having said first face, said second face, said suction pipe, said delivery pipe, said first and second inlet ducts and said first and second outlet ducts, said second body part;

having said first and second inlet ends of said first and second inlet ducts in said first face, having said first and second outlet ends of said first and second outlet ducts in said first face, being axially aligned with said first body part, including a perimeter which is attached to said first body part, having said first and second annular seats shaped like spectacles in plan view such that said first and second annular seats have respective and overlapping inlet and outlet sections located opposite one another, and wherein said suction pipe has an outlet adjacent said overlapping inlet sections and said delivery pipe has an inlet adjacent said overlapping outlet sections;

wherein said cover is piston shaped with a longitudinal axis and includes an eccentric guide extending axially; and wherein said pump body includes a third body part, said third body part;

having a cylindrical seat in which said cover is slidable axially and in a laterally sealed manner between the pumping position and the cleaning position, being axially aligned with said second body part and being attached to said second body part on a side opposite to said first body part, and including a passage for said eccentric guide of said cover whereby rotation of said cover is precluded; and wherein said actuator includes a pressure fluid means (a) for pressing said cover against the first face of said second body part when said cover is in the pumping position with a pressure greater than an operating pressure of the liquid product being pumped in order to close said annular seats, said inlet ends and said outlet ends and (b) for moving said cover between the pumping position to the cleaning position such that in the cleaning position cleaning liquid readily circulates through said annular seats, said inlet ducts and said outlet ducts.

4. A hydraulic pump as claimed in claim 3:

wherein said cover includes;

a cover member having a press face which engages said first face and an actuator face opposite to said press face, two of said eccentric guides each of which is a cylindrical pin, said pins extending perpendicularly from said actuator face and being angularly equidistant about the longitudinal axis of said cover and equally eccentric from said longitudinal axis, and a piston member attached to said pins distal from said actuator face;

wherein said third body part includes;

a bottom having a respective said passage for each said pin to pass through while being laterally sealed, such that a first sealed chamber is provided between said bottom and said actuator face of said cover member, and an extension member extending longitudinally beyond said bottom on a side of said bottom opposite said cylindrical seat in which said piston member moves in a laterally sealed manner such that a second sealed chamber is provided between said bottom and said piston member; and further including first and second passageways which connect to respective said first and second chambers whereby a source of fluid pressure is selectively fed (a) to said first passageway and into said first chamber to move said cover from the pumping position to the cleaning position, and (b) to said second passageway and into said second chamber to move said cover from the cleaning position to the pumping position and to hold said cover in the pumping position.

5. A hydraulic pump as claimed in claim 4:

wherein said first body part includes a flange; and wherein said first and second passageways comprise first and second ducts formed longitudinally in perimeters of said first, second and third body parts, said first and second passageways each ending in a threaded connection in said flange of said first body part.

6. A hydraulic pump as claimed in claim 5:

wherein said first and second ducts each include a small pipe located in said second body part which is sealed at each end in said first and third body parts.

7. A hydraulic pump as claimed in claim 6:

wherein said third body part is cup shaped with an open end and includes a perforated protective base which closes said open end.

8. A hydraulic pump as claimed in claim 7:

wherein said second body part includes lateral apertures in and distributed evenly about said perimeter of said second body part, whereby liquid product leaking past said first and second drive seals emerges through said apertures to provide a visual indication of a leak.

* * * * *